United States Patent [19]

Chandley

[11] Patent Number: 4,982,777

[45] Date of Patent: Jan. 8, 1991

[54] COUNTERGRAVITY CASTING METHOD AND APPARATUS

[75] Inventor: George D. Chandley, Amherst, N.H.

[73] Assignee: Metal Casting Technology Inc., Milford, N.H.

[21] Appl. No.: 303,813

[22] Filed: Jan. 27, 1989

Related U.S. Application Data

[63] Continuation-in-part of Ser. No. 234,583, Aug. 22, 1988, abandoned.

[51] Int. Cl.[5] ..... B22D 18/06

[52] U.S. Cl. ..... 164/63; 164/255

[58] Field of Search ..... 164/119, 255, 306, 63, 164/65, 256, 254, 361, 363, 364

[56] References Cited

U.S. PATENT DOCUMENTS

| | | | |
|---|---|---|---|
| 1,606,236 | 11/1926 | Kadow . | |
| 2,991,518 | 7/1961 | Schaefer | 22/73 |
| 3,032,841 | 5/1962 | Sylvester | 22/69 |
| 3,608,617 | 9/1971 | Burke et al. | 164/126 |
| 3,774,668 | 11/1973 | Heimgartner | 164/255 |
| 3,863,706 | 2/1975 | Chandly et al. | 164/62 |
| 3,998,264 | 12/1976 | Hocking | 164/251 |
| 4,112,997 | 9/1978 | Chandley | 164/119 |
| 4,340,108 | 7/1982 | Chandley | 164/63 |
| 4,589,466 | 5/1986 | Chandley et al. | 164/119 |
| 4,733,714 | 3/1988 | Smith | 164/306 |

*Primary Examiner*—Kuangy Lin

*Attorney, Agent, or Firm*—Reising, Ethington, Barnard, Perry & Milton

[57] ABSTRACT

A method for the differential pressure, countergravity casting of molten metal includes applying a differential pressure to urge molten metal through a constricted inlet passage into a mold cavity of a mold from an underlying molten metal pool, withdrawing the mold from the pool after the mold cavity is filled with the molten metal, holding the molten metal in the mold by combined differential pressure/molten metal surface tension holding action until the molten metal solidifies in the constricted inlet passage of the withdrawn mold or until the mold can be inverted. The differential pressure can be released after the metal solidifies in the inlet passage or after the mold is inverted to allow the molten metal to solidify under ambient pressure.

23 Claims, 4 Drawing Sheets

COUNTERGRAVITY CASTING METHOD AND APPARATUS

This application is a continuation-in-part of patent application Ser. No. 234,583 filed Aug. 2, 1988, now abandoned.

FIELD OF THE INVENTION

The present invention relates to the countergravity casting of molten metal in a gas permeable casting mold and, in particular, to the countergravity casting of molten metal in shortened cycle times by reducing the time that a differential pressure must be applied to the casting mold after it is filled with molten metal and during solidification of the molten metal in the casting mold.

BACKGROUND OF THE INVENTION

The Chandley U.S. Pat. No. 4,112,997 issued Sept. 12, 1978, illustrates the countergravity casting of molten metal in a gas permeable shell mold wherein the lower end of a riser passage is submerged in a molten metal pool, a reduced pressure is applied to a plurality of mold cavities through the gas permeable walls of the mold to urge molten metal to flow upwardly through a stabilizing and filtering screen in each ingate to each mold cavity to fill each mold cavity with molten metal. After the mold cavities are filled with molten metal and most of the casting has solidified, the mold is removed from the molten metal pool with the reduced pressure maintained on the mold cavities. Upon removal of the mold from the molten metal pool, the molten metal in the riser passage and in the portion of the ingates between the stabilizing and filtering screen and the riser passage drains from the mold by gravity-induced run-out before the molten metal in the mold cavities is completely solidified. The molten metal in the mold cavities and in the portion of the ingates between the stabilizing and filtering screen and the mold cavity is held against run-out by the reduced pressure applied on the mold cavities and by the stabilizing effect of the stabilizing and filtering screens on the molten metal. After at least a solidified skin of metal is formed in the mold cavity and in the portion of the ingates between the screen and the mold cavity, the reduced pressure applied to the mold is released. However, as a result of the small dimension of the stabilizing and filtering screen in the direction of molten metal flow, the reduced pressure must be applied to the mold cavities for a relatively long time, e.g., 200 seconds, until the solidified skin forms in the mold cavity and in the portion of the ingates between the screen and the mold cavity. This prolongs the casting cycle time, and reduces the rate of production of solidified castings. Moreover, stabilizing and filtering screens suitable for use in the casting of high melting point metals (e.g., metals having melting temperatures above about 2950 F.) are expensive and increase the cost of the castings so produced.

The Chandley et al U.S. Pat. No. 4,589,466 issued May 20, 1986, illustrates the countergravity casting of molten metal wherein a gas permeable mold includes a crimpable fill pipe sealingly connected to the lower end of the riser passage and adapted for immersion in an underlying molten metal pool during casting to fill a plurality of mold cavities in the mold. Once the mold cavities are filled with molten metal by countergravity casting from the underlying casting melt, the fill pipe is crimped closed while immersed in the molten metal pool to prevent molten metal run-out upon subsequent removal of the fill pipe from the molten metal pool. Molten metal remains and solidifies in the fill pipe above the crimped portion and in the mold cavities, the intermediate riser passage and the ingates to each mold cavity. In the casting of higher melting point metals the use of a crimpable fill pipe provides an unsatisfactory degree of reliability since the hot metal can occasionally melt through the fill pipe even when it is coated with a ceramic wash or layer. Moreover, the crimped fill pipe is not reuseable.

The Sylvester U.S. Pat. No. 3,032,841 issued May 8, 1982, illustrates in one embodiment an ingate structure through which molten metal is supplied in countergravity fashion to fill a plurality of gas impermeable molds. A stopper valve is disposed in the ingate structure between a depending fill tube and the mold cavities and is movable in the ingate structure to a closed position after the mold cavities are filled to prevent molten metal run-out. After the stopper is moved to the closed portion, the molten metal in the ingate passages above the valve is allowed to at least partially solidify to substantially close the ingate passages. Thereafter, the molds and the ingate structure are separated as a unit from the fill tube and then the molds are subsequently separated from the ingate structure. The patent indicates that the viscosity and surface tension of molten metal, if any, in the restricted (partially closed) ingate passages prevents run-out of molten metal therefrom, even though the metal above and below the ingate passages may still be in the molten state.

It is an object of the invention to provide a method and apparatus for the differential pressure, countergravity casting of molten metal in substantially shortened cycle times by differential pressure, countergravity filling a mold having a mold cavity and a constricted molten metal inlet means for supplying the molten metal to the mold cavity when a lower mold portion is immersed in an underlying molten metal pool and then withdrawing the mold from the pool while holding the molten metal in the inlet passage means which is so constricted in size as to coact with a differential pressure maintained on the molten metal in the mold to substantially prevent molten metal run-out from the mold before the metal solidifies in the inlet passage means or before the mold is inverted.

It is another object of the invention to provide a method and apparatus for the differential pressure, countergravity casting of molten metal in substantially shortened cycle times by differential pressure, countergravity filling of a mold having a bottom fill passage immersed in an underlying molten metal pool, withdrawing the mold from the pool and draining the molten metal from the fill passage while the molten metal in the mold remains liquid and unsolidified and is held in constricted inlet passage means in the mold above the fill passage by a combination of differential pressure and molten metal surface tension holding action applied to the molten metal in the constricted inlet passage means.

It is another object of the invention to provide a method and apparatus for the differential pressure, countergravity casting of molten metal using a bottom fill tube on the mold that can be drained of molten metal following filling of the mold cavities to lessen the amount of metal used in the gating of the casting and that is removable after the mold cavity is filled with molten metal for reuse in the casting of successive molds.

SUMMARY OF THE INVENTION

The invention contemplates a method for the countergravity casting of molten metal including forming a mold having a mold cavity and a molten metal inlet passage means communicating the mold cavity with a lower mold portion adapted for immersion in an underlying molten metal pool, relatively moving the mold and the pool to immerse the lower mold portion in the pool and applying a differential pressure between the mold and the pool to draw the molten metal upwardly through the inlet passage means into the mold cavity to fill the mold cavity with the molten metal. Following filling of the mold cavity, the mold and the pool are relatively moved to remove the lower mold portion from the pool. During removal of the mold from the pool, a negative differential pressure is maintained on the molten metal in the mold and the molten metal is held in the inlet passage means which is sufficiently constricted in size to so coact with the differential pressure maintained thereon as to substantially prevent molten metal run-out from the inlet passage means and the mold cavity thereabove after removal of the lower mold portion from the pool and before solidification of the molten metal in the constructed inlet passage means. In one embodiment of the invention, the molten metal is solidified in the constricted inlet passage means shortly after withdrawal of the mold from the pool and before solidification of the molten metal in the mold cavity above the inlet passage means. Solidification of the molten metal in the inlet passage means occurs rapidly as a result of cooling action provided by air drawn through the gas permeable mold walls by the differential pressure. The differential pressure is released after the metal solidifies in the constricted inlet passage means.

In another embodiment of the invention, the mold is inverted after withdrawal of the lower mold portion from the pool while molten metal run-out from the mold is prevented. The differential pressure is released upon inversion of the mold to allow the molten metal to solidify under ambient pressure in the inlet passage means and the mold cavity of the inverted mold.

In another embodiment of the invention, a mold fill passage below the constricted inlet passage means is drained upon removal of the mold from the pool while molten metal is prevented from running out of the inlet passage means and the mold cavity in the manner described hereinabove.

The molten metal is typically held in the constricted inlet passage means and the mold cavity thereabove after removal of the mold from the pool by maintaining the differential pressure on the molten metal in the mold as the mold is removed from the molten metal pool and establishing, for a given differential pressure maintained on the molten metal, a molten metal surface tension holding action in the constricted inlet passage means. The desired molten metal surface tension holding action is established by appropriate selection of the size of the inlet passage means and the surface tension characteristics of the mold material contacting the molten metal in the inlet passage means. The constricted inlet passage means may comprise a plurality of inlet passages disposed side-by-side in the mold between a bottom mold fill passage and the mold cavity and constricted in size to establish the aforementioned molten metal surface tension holding action. A single constricted inlet slit or slot may also be used to this same end.

In another embodiment of the method of the invention, the fill passage is removed from the mold after it is drained, either before or after the mold is invented.

The invention also contemplates a countergravity casting apparatus having a mold cavity and a constricted inlet means communicating the mold cavity with a lower mold portion adapted for immersion in an underlying molten metal pool, means for relatively moving the mold and the pool to immerse the lower mold portion in the pool, and means for applying a differential pressure between the mold and the pool to draw molten metal upwardly through the inlet passage means and into the mold cavity. The casting apparatus also includes means for withdrawing the lower mold portion from the molten metal after the mold cavity is filled with the molten metal and means for applying a combined differential pressure and molten metal surface tension holding action to the molten metal in the constricted inlet passage means as the lower mold portion is removed from the pool sufficient to hold the molten metal in the inlet passage means and the mold cavity thereabove for a period of time after removal of the mold from the pool to permit the molten metal in the inlet passage means to solidify or to permit inversion of the mold.

In one embodiment of the apparatus of the invention, the means for holding the molten metal in the inlet passage means and the mold cavity after the mold is removed from the pool includes a molten metal holding member disposed in the mold and having one or more specially sized (restricted cross-section) molten metal inlet passages for establishing a sufficient surface tension holding action, for a given differential pressure maintained on the molten metal therein, during removal of the mold from the pool to prevent molten metal run-out from the mold cavity until the molten metal is solidified in the inlet passage means or the mold is inverted.

In another embodiment of the apparatus of the invention, a ceramic fill tube is releasably, sealingly connected to the bottom of the mold to admit molten metal to a vertical riser passage disposed above in the mold and forming an extension of the mold cavities in the mold. The perforate molten metal holding member is disposed between the fill passage and the riser passage. The riser passage feeds the molten metal to the plurality of mold cavities. The ceramic fill tube is removed from the bottom of the mold after the mold is removed from the pool before or after the mold is inverted, for reuse in the casting of successive molds.

BEST MODE OF PRACTICING THE INVENTION

Figure 1:
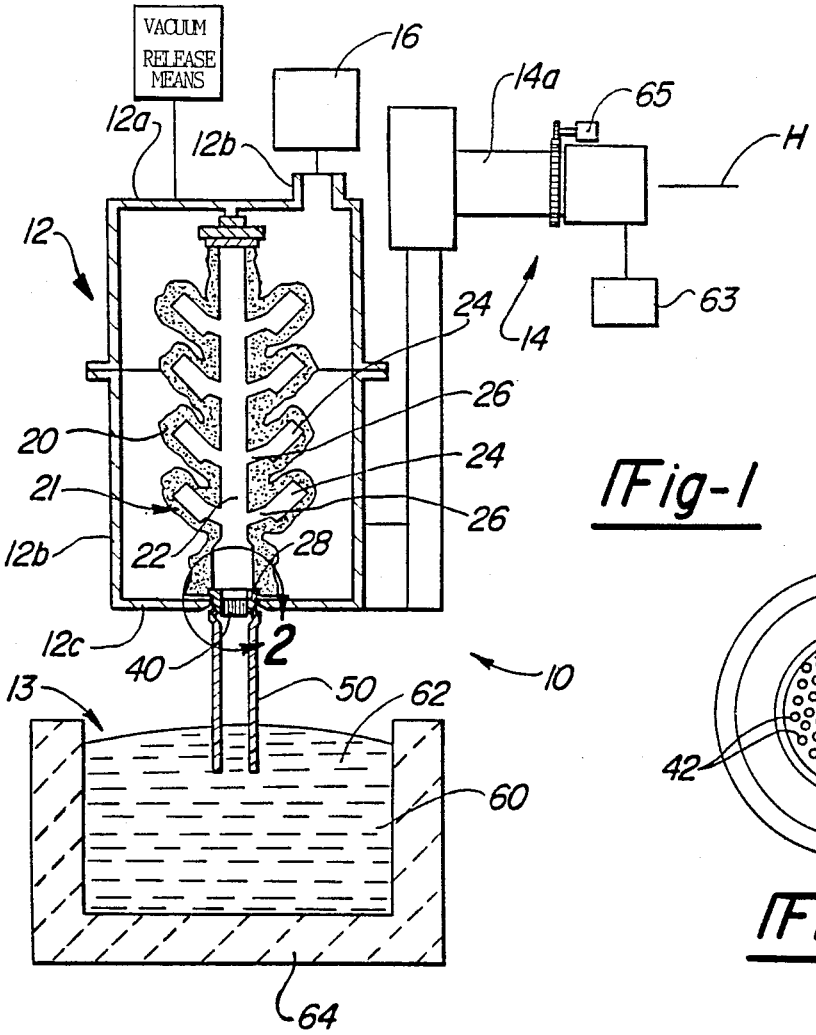
FIG. 1 is a schematic sectioned elevational view of a casting apparatus according to the invention for practicing the method of the invention.
Figure 6:
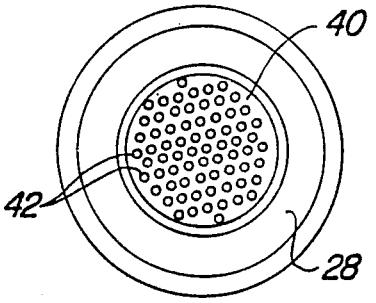
FIG. 6 is an elevational view of the bottom of the perforate ceramic insert that is incorporated into the casting mold.
Figure 2:
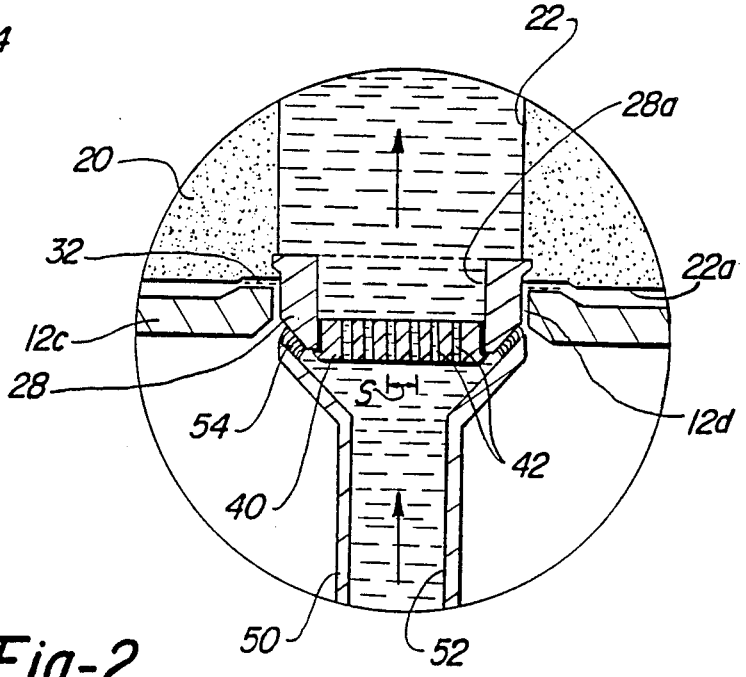
FIG. 2 is an enlarged view of the encircled portion of FIG. 1 after countergravity filling of the mold with molten metal from the underlying molten metal pool.

Referring to the drawings, there is provided a casting apparatus 10 including a partitioned, sealable casting chamber 12 mounted on a vertically movable and horizontally rotatable support arm 14. The casting chamber 12 includes an upper wall 12*a* having a conduit 12*b* communicated to a differential pressure apparatus 16, e.g., a vacuum pump, and a lower, mold supporting wall 12*c* for supporting a porous, gas permeable mold 20, which is shown as a ceramic investment shell mold, although the invention is not so limited (see FIG. 7). The gas permeable mold 20 includes a main mold cavity 21 having a longitudinal, vertical riser passage 22 communicating with a plurality of article-shaped mold cavities 24 thereabove via respective lateral ingate passages 26. The article-shaped mold cavities 24 are configured in the shape of the articles to be cast.

The gas permeable mold 20 includes an annular, ceramic collar 28 captured in the open lower end of the mold. The ceramic mold collar extends below the mold bottom 22*a* through a central opening 12*d* in lower, mold-supporting wall 12*c* of the casting chamber 12. A fibrous refractory vacuum seal 32 is provided between the collar 28 and the mold-supporting wall 12*c*. The collar 28 includes a central riser passage 28*a* cooperating with the vertical riser passage 22 to supply molten metal to the mold cavities 24.

A perforate molten metal holding member 40 in the form of a perforate ceramic disk insert is disposed and sealingly attached in the collar 28 between the riser passages 22,28 and a fill passage 52 to be described below. The molten metal holding member 40 and collar 28 can be formed as one component. The holding member 40 functions primarily as a molten metal holding means for retaining molten metal in the mold 20 as will be explained below and only secondarily as a strainer or filter to prevent oxide, slag and other debris particles in the molten metal from entering the mold 20. To this end, the ceramic disk insert 40 includes a plurality of longitudinal (vertical) inlet passages 42 whose size and lateral spacing from one another is selected primarily to establish a molten metal surface tension holding action on the molten metal present in the inlet passages 42 during draining of the molten metal from an elongate, ceramic mold fill pipe 50 as will be explained herebelow. As is apparent, the inlet passages 42 have a substantially constricted (reduced) cross-sectional e.g., diameter) as compared to that of the fill passage 52 to this end.

The elongate ceramic mold fill pipe 50 defines a longitudinal fill passage 52 therein and is sealingly attached to the mold collar 28 by ceramic adhesive 54. As shown best in FIG. 1, the elongate ceramic fill pipe 50 depends from the bottom side 20*a* of the mold 20 toward an underlying molten metal pool 60 formed by molten metal 62 held in a crucible or container 64. The cross-section (e.g., diameter) of the fill pipe 50 is relatively large compared to the cross-section (e.g., diameter) of the inlet passages 42 in the insert 40.

The casting chamber 12 with the mold 20 supported therein is lowered on the support arm 14 toward the molten metal pool 60 to immerse the open lower end of the ceramic fill pipe 50 in the molten metal 62, FIG. 1. The support arm 14 is lowered by a suitable actuator 63 (shown schematically) such as a hydraulic pneumatic, electrical or other actuator. After the fill pipe 50 is immersed in the molten metal, a vacuum is drawn in the casting chamber 12 by differential pressure apparatus 16 (vacuum pump) through the conduit 12*b*. Drawing of the vacuum in the casting chamber 12 evacuates the mold cavities 24 through the porous, gas permeable mold 20 and applies a differential pressure to the mold 20 relative to the molten metal pool 13 to cause the molten metal 62 to flow upwardly through the fill pipe 50, ceramic insert 40, the riser passage 22, and the lateral ingate passages 26 to fill the mold cavities 24 with the molten metal. During filling of the mold cavities 24 in this manner, the molten metal entering the mold is filtered by the inlet passages 42 in the ceramic insert 40 to remove objectionable particles therefrom too large to pass through the passages 42. However, this filtering action by the molten metal holding member 40 is only a secondary consequence of practicing the invention, the primary consequence and objective being molten metal retention in the casting mold 20 after mold filling and during draining of molten metal 62 from the fill passage 52 prior to inversion of the mold 20, as will be explained below.

Figure 3:
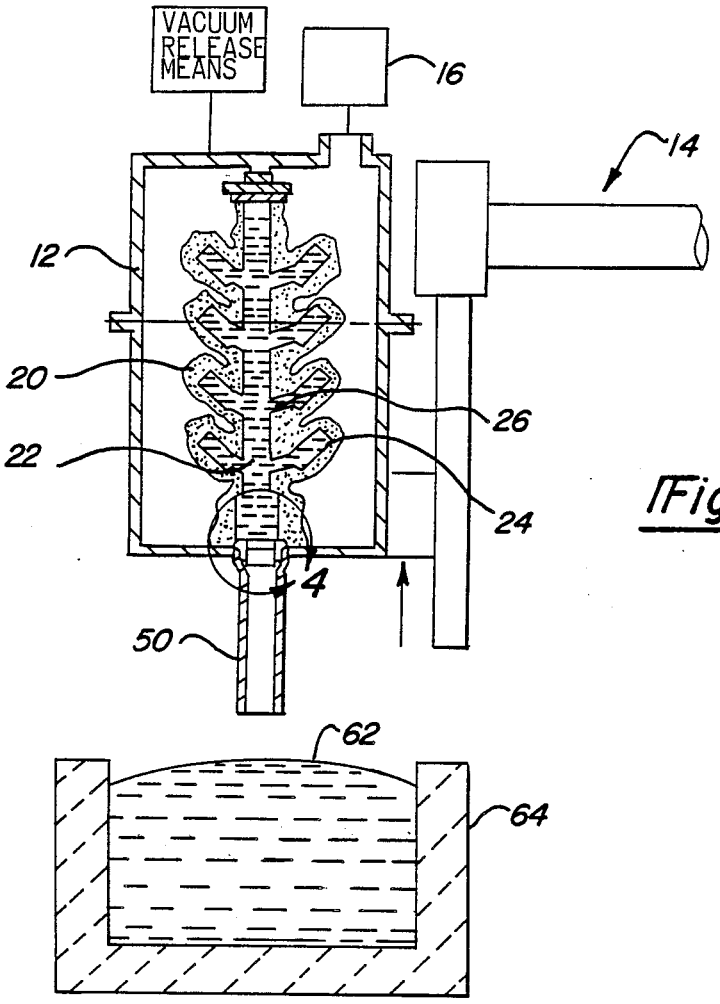
FIG. 3 is similar to FIG. 1 with the mold fill pipe withdrawn from the molten metal pool for draining of molten metal therefrom.

After the mold cavities 24 are filled, the support arm is raised by the actuator 63 to raise the casting chamber 12 and molten metal-filled mold 20 supported thereon a sufficient distance away from the molten metal pool 60 to withdraw the open lower end of the fill pipe 50 from the molten metal 12, FIG. 3. During raising of the casting chamber 12 and the mold 20 supported therein, the vacuum is maintained in the casting chamber 12 by the differential pressure apparatus 16.

Figure 4:
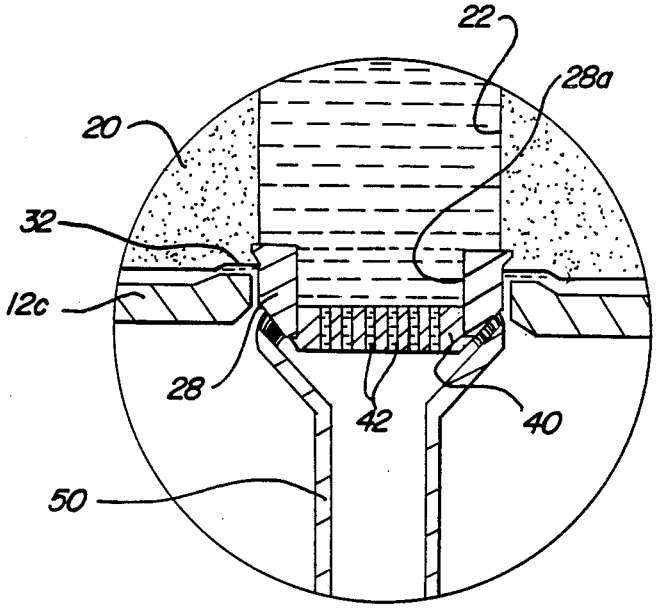
FIG. 4 is an enlarged view of the encircled portion of FIG. 3 after the fill tube is drained of molten metal.

Upon withdrawal of the fill pipe 50 from the molten metal pool 60, the molten metal in the fill pipe 50 begins to drain out by gravity-induced run-out due to the relatively large diameter of the fill passage 52, FIGS. 3 and 4. However, the molten metal in the constricted, longitudinal inlet passages 42 in the ceramic insert 40 and the molten metal above the ceramic insert 40 (i.e., in the main mold cavity 21) is held against gravity-induced run-out at least until the fill pipe 50 is drained of molten metal and the mold 20 is inverted, by a combination of the differential pressure applied to the mold 20 (and thus to the molten metal in the inlet passages 42 and the main mold cavity 21) and by a molten metal surface tension holding action established in the constricted longitudinal inlet passages 42 of the insert 40. In particular, the selection of the number, size, spacing and shape of the inlet passages 42 is based on the need (1) to fill the mold cavities 24 in a relatively short time to prevent metal solidification before the mold cavities 24 are filled and the mold 20 is inverted and (2) to hold, for a given applied differential pressure, the molten metal in the inlet passages 42 and in the mold cavity 21 thereabove when the fill tube 50 is removed from the molten metal pool 60, at least until the fill tube can be drained of molten metal and the mold 20 can be inverted. The number, cross-sectional size (e.g., diameter), and vertical length of the inlet passages 42 which will prove useful depends in part on the surface tension of the molten metal being cast as well as the surface tension between the molten metal and the particular ceramic material from which the insert 40 is made. Higher surface tension values for the molten metal and between the molten metal and the ceramic strainer insert 40 enable use of a larger number of larger sized (larger diameter ) inlet passages 42.

Furthermore, the lateral spacing S between adjacent inlet passages 42 is controlled to prevent "creeping" of the molten metal 12 from one inlet passage 42 to another on the bottom side of the insert 40 and eventual joining of the molten metal 12 in the various inlet passages 42. Once the molten metal 12 in the various inlet passages 42 joins on the bottom side of the insert 40, the molten metal 12 may run-out from the inlet passages 42 before the fill tube 50 is drained and the mold 20 is inverted. The amount of lateral spacing S required between the inlet passages 42 to prevent such "creeping" and joining of the molten metal 12 will depend on the surface tension of the molten metal relative to the ceramic of the insert 40.

Figure 5:
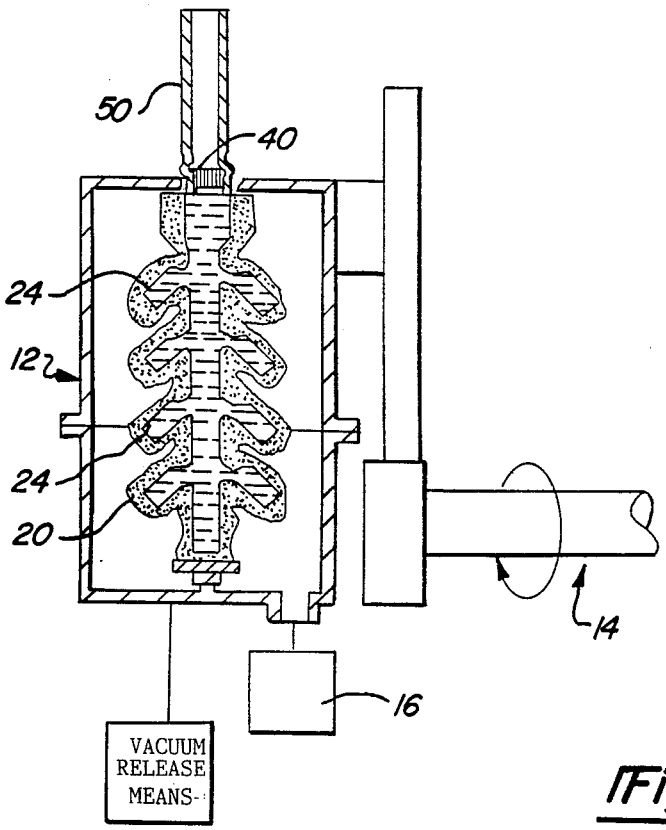
FIG. 5 is a schematic sectioned elevational view of the casting apparatus after the mold is inverted to effect solidification of the molten metal in the inverted mold.

As an illustrative example only, in the casting of a high shrinkage stainless steel Type 17-4PH (35 pounds of stainless steel) in a conventional ceramic shell mold 20 at a reduced pressure of five psia in the casting chamber 12, a silica strainer insert 40 having seventy (70) cylindrical inlet passages 42 of 0.095 inch diameter and 0.25 inch vertical length and spaced apart by a spacing S of about 0.130 inch proved satisfactory in holding the molten metal in the passages 42 of the strainer insert 40 for at least about 3 seconds during draining of the molten metal from the fill tube 50 (inner diameter 1.5 inch). This time period was sufficient to fully drain the fill tube 50 and then invert the mold 20 to the position of FIG. 5 without any gravity-induced molten metal run-out from the inlet passages 42. Using a less wettable ceramic, such as zirconia, for the ceramic insert 40 may increase the usable diameter of the cylindrical inlet passages to a maximum of about 0.156 inch for casting most metals or alloys under these same conditions.

Typically, the molten metal will be held in the inlet passages 42 for at least several seconds for high shrinkage alloys, such as stainless steels, superalloys and the like, and for longer times for low shrinkage alloys, such as cast iron, after the fill pipe 50 is withdrawn from the molten metal pool 60. This delay period for run-out of molten metal from the inlet passages 42 provides an opportunity to invert the casting chamber 12 and the mold 20 to orient the mold bottom **22*a* to face upwardly, FIG. 5, while the molten metal in the inlet passages 42, riser passage 28, lateral ingates 26 and mold cavities 24 remains in the liquid state. A rotary actuator 65 of the conventional type is provided to rotate an extension 14*a* of the support arm 14 about a horizontal axis H to invert the casting chamber 12 and the molten metal-filled mold 20** therein.

The molten metal in the inlet passages 42 and the mold cavities 24 remains in the unsolidified, liquid state while the fill passage 52 is drained and before the metal-filled mold 20 is inverted.

After the mold is inverted, the fill pipe 50 is removed from the collar 28 and the differential pressure applied to the mold 20 is released (by vacuum releasing means providing ambient pressure in the casting chamber 12) to allow the molten metal in the inlet passages 42, riser passage 28, ingate passages 26 and the mold cavities 24 to solidify in the inverted mold under ambient pressure. Upon removal of the fill pipe 50, the molten metal in the inlet passages 42 radiates heat rapidly and solidifies in a matter of seconds.

Following release of the differential pressure on the inverted, molten metal-filled mold 20, the casting chamber 12 is free for removal from the mold 20 and can be used in casting the next successive mold 20. As a result, the casting cycle time is reduced and the production throughput of the casting process is increased.

Use of the ceramic fill pipe 50 improves reliability of the casting process since the possibility of melt-through of the fill pipe 50 by the molten metal is essentially eliminated. Use of the ceramic fill pipe 50 also reduces the cost of casting since the fill pipe can be reused to cast successive molds.

Figure 7:
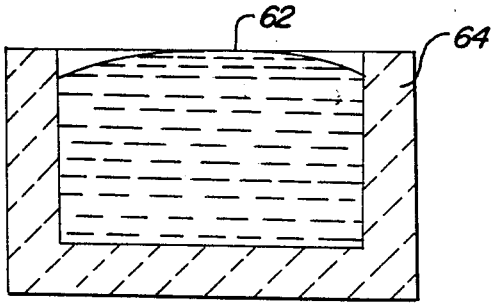
FIG. 7 is a schematic sectioned elevational view of another embodiment of the invention.
Figure 7:
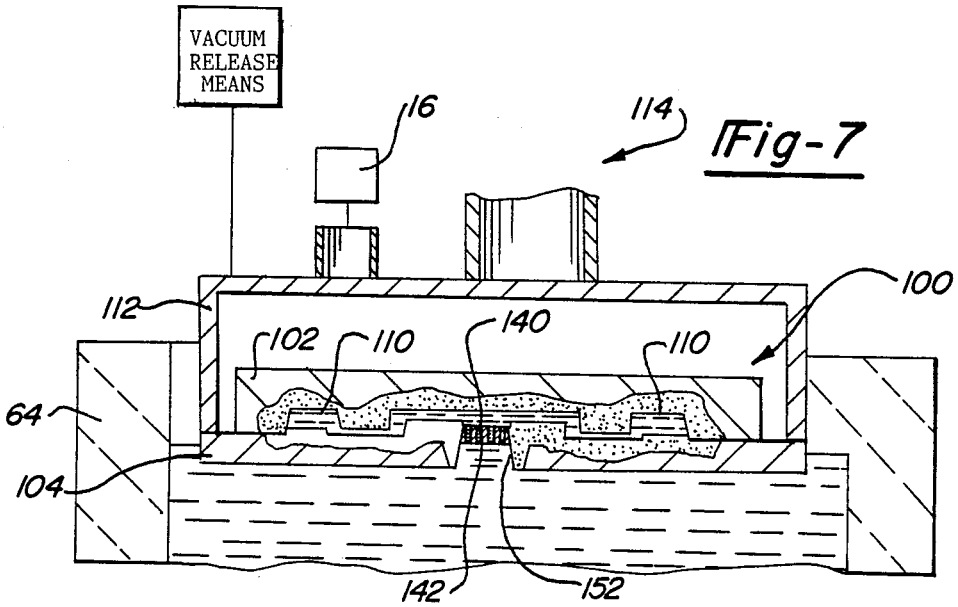

FIG. 7 illustrates another embodiment of the invention wherein a resin-bonded sand mold 100 is disposed in a casting chamber 112 mounted on a support arm 114. The mold 100 includes a porous, gas permeable upper mold member 102 and a lower member 104 engaged together by suitable means and defining a plurality of mold cavities 110 therebetween. The lower mold member 104 includes a fill passage 152 formed integrally therewith. A ceramic insert 140 is disposed in the fill passage 152 and includes a plurality of inlet passages 142 that function in the manner described hereinabove with respect to FIGS. 1–5. The mold 100 of FIG. 7 is used to practice the method of the invention in the same manner described hereinabove for FIGS. 1–5 with the exception that there is no separate fill tube to be removed after mold withdrawal from the molten metal pool 13.

Although FIG. 7 illustrates single fill passage 152 for supplying molten metal to the plurality of mold cavities 110, it is possible to employ a separate fill passage 152 for each mold cavity with a ceramic insert 140 in the fill passage 152 of each fill tube.

Figure 8:
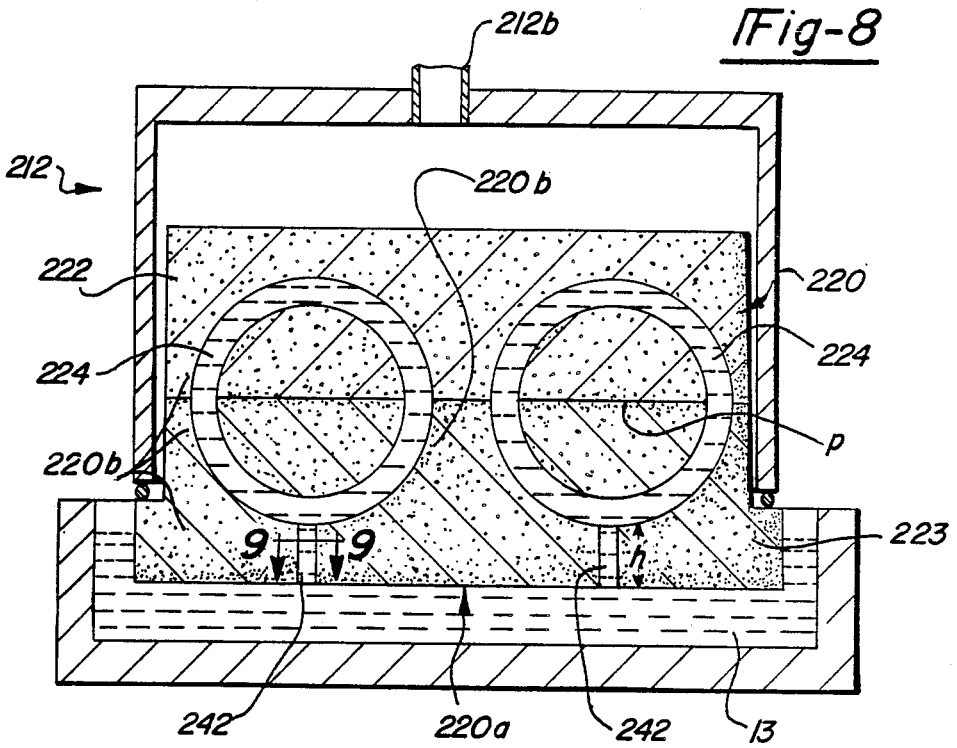
FIG. 8 is a schematic sectioned elevational view of a casting apparatus of another embodiment of the invention.
Figure 9:
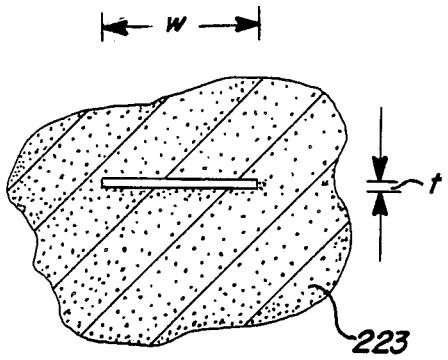
FIG. 9 is an enlarged horizontal cross-sectional view taken along lines 9—9 of FIG. 8 showing one of the inlet passages.

Moreover, although a plurality of constricted, cylindrical inlet passages 142 are described and shown in FIGS. 1–7, those skilled in the art will appreciate that a single inlet passage in the form of a narrow slit or slot can also be employed in the apparatus shown in these figures (e.g., see in FIG. 8).

The method of the invention has been described hereinabove as including a mold inversion step after the mold 20 (100) is withdrawn from the pool 13 and before molten metal runs out of the mold. A vacuum release step is effected after the mold is inverted to allow the molten metal to solidify under ambient pressure in the inverted mold. This embodiment of the invention can be used in casting both low shrinkage metals (e.g., grey and nodular cast iron) and high shrinkage metals (e.g., stainless and other steels). The terms low shrinkage or high shrinkage refers to the volumetric contraction of the molten metal when it is cooled from the casting temperature to ambient temperature during the solidification step of the process. Certain steels exhibit a high volumetric shrinkage such as about 10% upon cooling from the casting temperature to ambient temperature whereas grey and nodular cast irons exhibit relatively low volumetric shrinkage such as less than about 1%.

Low shrinkage metals (e.g., grey and nodular irons) can be cast in accordance with a variation of the method of the invention wherein the mold is not inverted after it is removed from the pool 13. For example, referring to FIG. 3, after the mold cavities 24 are filled with the molten metal, the mold 20 is raised to withdraw the fill pipe 50 from the pool and allow the fill pipe 50 to drain molten metal therein back into the pool 13. However, as the fill pipe 50 is drained, the molten metal in the inlet passages 42 and the mold cavities 24 is prevented from draining out by maintaining the vacuum in the casting chamber 212 and establishing the desired molten surface tension holding action on the molten metal in the passages 42 as explained hereinabove. Upon removal of the fill pipe 50 from the pool 13 to the position shown in FIG. 3, the molten metal in the inlet passages 42 radiates heat rapidly and is cooled by air circulation about the fill pipe 50 such that the molten metal rapidly solidifies (within about 30 seconds) in the inlet passages 42, where it is held by the combination of the negative differential pressure maintained on the molten metal and the surface tension holding action established by the inlet passage 42 sized to this end. The molten metal in each inlet passage 42 solidifies before the molten metal thereabove in the mold. The vacuum in the casting chamber 12 is released once the molten metal solidifies in the inlet passages 42 since the solidified metal will prevent run-out of molten metal from the mold cavities 24. The mold and the casting chamber can then be separated to free the casting chamber 12 for use in casting another mold 20.

In an alternative embodiment, the fill pipe 50 can be removed from the mold collar 2 after it is removed from the pool 13, FIG. 3, and after it is drained of molten metal. Upon removal of the fill pipe 50, the molten metal in the inlet passages 42 radiates heat rapidly and is cooled by air flow about collar 28 and insert 40 such that the molten metal rapidly solidifies in the inlet passages 42 before the molten metal thereabove in the mold. The vacuum in the casting chamber 12 can then be released.

FIG. 8 illustrates another embodiment of the invention for casting low shrinkage metals, such as grey and nodular cast iron, without a mold inversion step in a mold 220 having a gas permeable upper mold member 222 and a lower mold member 223, which may be gas permeable or impermeable, sealingly engaged at a horizontal parting plane P. This embodiment differs from those described hereinabove in that a single constricted molten metal inlet passage 242 is employed to admit the molten metal to each annular mold cavity 224. Each inlet passage 242 is in the form of a narrow slit or slot extending between a lower or bottom side **220*a* of the gas permeable mold 220 and the respective mold cavity 224 located thereabove in the mold. The mold 224 can be of the resin-bonded sand type or ceramic investment type known in the art and is sealingly received in a casting chamber 212 that is adapted to be evacuated through conduit 212*b* as described hereinabove for FIGS. 1–7**.

The mold cavities 224 are filled with the molten metal by immersing the bottom side **220*a* in the underlying molten metal pool 13 while evacuating the casting chamber 212 sufficiently to urge the molten metal upwardly through each inlet passage 242 into the respective mold cavity 224 thereabove to fill them with the molten metal. After the mold cavities 224 are filled, the casting chamber 212 and the mold 220 are raised upwardly to withdraw the bottom side 220*a* of the mold 220 from the pool 13. During withdrawal, the casting chamber 212 continues to be evacuated to exert a negative differential pressure on the molten metal in the inlet passages 242 and the mold cavities 224 and also to draw air through the gas permeable side 220*a* and gas permeable walls 220*b* of the mold. As a result of the coaction of the differential pressure and the constricted size of each inlet passage 242 (exerting a surface tension holding action on the molten metal therein), the molten metal in the inlet passages 242 and thus the mold cavities 224 is prevented from running out of the mold 220 after the bottom side 220*a* is withdrawn from the pool 13**, even though the metal therein remains molten and unsolidified.

After withdrawal of the bottom side **220*a* from the pool 13, the molten metal in the inlet passages 242 solidifies rapidly before the molten metal in the mold cavities 224 by virtue of its thin cross section and by rapid radiation of heat therefrom as well as the cooling action exerted by the ambient air being drawn through the gas permeable side/walls 220*a*,220*b* of the mold 220. After the molten metal solidifies in the inlet passages 242, the vacuum in the chamber 212 is released and the solidified molten metal in the inlet passage 242 prevents run-out of the molten metal in the mold cavities 224. The metal-filled mold 220 and the casting chamber 212** can than be separated to free the casting chamber for use in casting another mold.

An inlet passage 242 in the form of a narrow slot of rectangular cross-section has been used to successfully practice the invention. A rectangular slot having a width w of about one inch, a thickness t of about 1/32 inch to 1/16 inch and a height h of about 1½–3 inches has been used to cast 19 pounds of cast iron into a resin bonded sand mold 220 at a pressure level of 6.4 psia in the casting chamber 212. Each inlet passage 242 is provided with at least one narrow dimension, such as the thickness t, which preferably is 1/16 inch or less. However, those skilled in the art will appreciate that the inlet passage 242 may assume other configurations and sizes depending on the metal being cast, its surface tension as well as the surface tension between the metal being cast and the type of mold material contacting the molten metal in the inlet passage 242. Multiple, spaced inlet passages 242 may also be employed.

The present invention can also be practiced with countergravity casting processes and apparatus that use destructible patterns suspended in a mass of particulate mold material to define mold cavities in the particulate mass.

While the invention has been described in terms of specific embodiments thereof, it is not intended to be limited thereto but rather only to the extent set forth hereafter in the following claims.

I claim:

1. A method for the countergravity casting of molten metal, comprising:

(a) forming a mold having a mold cavity, a lower mold portion adapted for immersion in an underlying molten metal pool and a constricted inlet passage means between the mold cavity and the lower mold portion, (b) relatively moving the mold and the pool to immerse said lower mold portion in the pool, (c) applying a differential pressure between the mold cavity and the pool to urge the molten metal upwardly through the inlet passage means into the mold cavity to fill the mold cavity with the molten metal, (d) relatively moving the mold and the pool to withdraw said lower mold portion from the pool while the entire metal in said mold cavity and inlet passage means remains in the molten state, including maintaining a differential pressure on the molten metal in the inlet passage means which is so constricted in size as to coact with said differential pressure to substantially prevent the molten metal from running out of said inlet passage means and said mold cavity after withdrawal of said lower mold portion from the pool and before the molten metal solidifies in said inlet passage means, and (e) solidifying the molten metal in said inlet passage means.

2. The method of claim 1 including inverting the mold after withdrawal of said lower mold portion from the pool and before molten metal runs out of the mold cavity to allow the molten metal to solidify in the inlet passage means and the mold cavity of the inverted mold.

3. The method of claim 2 including releasing the differential pressure maintained on the molten metal by providing ambient pressure about the mold after the mold is inverted.

4. The method of claim 1 wherein the step (e), the molten metal solidifies in said inlet passage means before it solidifies in the mold cavity.

5. The method of claim 4 including releasing the differential pressure maintained on the molten metal by providing ambient pressure about the mold after the molten metal solidifies in said inlet passage means whereby the solidified metal in the inlet passage means prevents run out of molten metal from the mold cavity thereabove.

6. The method of claim 4 including drawing air through walls of said mold to exert a cooling action on the molten metal in said inlet passage means.

7. The method of claim 1 wherein said inlet passage means comprises a passage extending between a bottom side of the mold and the mold cavity, said bottom side being adapted for immersion in the pool.

8. The method of claim 1 wherein said inlet passage means is disposed between an upstanding fill tube depending from a bottom side of the mold and an upstanding riser passage in the mold, said fill tube being adapted for immersion in the pool.

9. The method of claim 1 wherein the inlet passage means is so constricted in size to exert a molten metal surface tension holding action on the molten metal therein.

10. A method for the countergravity casting of molten metal, comprising:

(a) relatively moving a mold having an upstanding fill passage on a bottom side thereof and an underlying molten metal pool to immerse the fill passage in the pool for supplying the molten metal to a mold cavity thereabove in the mold through upstanding constricted inlet passage means disposed in the mold between the fill passage and the mold cavity, (b) applying a differential pressure between the mold and the pool while the fill passage is immersed in the pool to draw molten metal upwardly through the fill passage, the inlet passage means and into the mold cavity to fill said mold cavity with said molten metal, (c) relatively moving the mold and pool to remove the fill passage from the pool after the mold cavity is filled with said molten metal while the entire metal in said mold cavity and inlet passage means remains in the molten state, including (1) draining the molten metal from the fill passage and (2) maintaining a differential pressure on the molten metal in the mold for holding the molten metal in the constricted inlet passage means and the mold cavity thereabove until the fill passage is drained of molten metal and the mold can be inverted, (d) inverting the mold after the fill passage is drained and before the molten metal runs out from the inlet passage means and the mold cavity, and (e) solidifying the molten metal in the inverted mold.

11. The method of claim 10 including releasing the differential pressure maintained on the molten metal in step (c) by providing ambient pressure about the mold after the mold is inverted in step (d).

12. The method of claim 10 wherein the molten metal is held in the inlet passage means by maintaining the differential pressure on the molten metal and establishing, for a given differential pressure, a molten metal surface tension holding action in the constricted inlet passage means to at least delay molten metal run-out from the inlet passage means and the mold cavity until the fill passage is drained and the mold is inverted.

13. The method of claim 10 including removing the fill passage from the mold after the fill passage is drained.

14. The method of claim 13 wherein the fill passage is removed after the mold is inverted.

15. A method for the countergravity casting of molten metal, comprising:

(a) relatively moving a (1) mold having an upstanding fill passage on a bottom side thereof for admitting molten metal to a mold cavity thereabove through a plurality of upstanding constricted inlet passages disposed in the mold between the fill passage and the mold cavity and (2) an underlying molten metal pool to immerse the fill passage in the underlying pool of molten metal, (b) applying a differential pressure between the mold and the pool while the fill passage is immersed in the pool to draw molten metal upwardly through the fill passage and the inlet passages to fill the mold cavity with the molten metal, (c) relatively moving the mold and the pool to remove the fill passage from the pool after the mold cavity is filled with molten metal while the entire metal in said mold cavity and inlet passages remains in the molten state, including (1) draining molten metal from the fill passage and (2) maintaining a differential pressure on the molten metal in the mold and establishing, for a given differential pressure, a molten metal surface tension holding action in the constricted inlet passages, sufficient to hold the molten metal in the inlet passages and the mold cavity thereabove until the fill passage is drained of molten metal and the mold can be inverted, (d) inverting the mold after the fill passage is drained and before molten metal runs out of the inlet passages and the mold cavity, and (e) solidifying the molten metal in the inverted mold.

16. The method of claim 15 including releasing the differential pressure maintained on the molten metal in step (c) by providing ambient pressure about the mold after the mold is inverted in step (d).

17. The method of claim 15 including disposing the inlet passages in a side-by-side pattern in the path of the upward molten metal flow from the fill passage.

18. The method of claim 17 wherein the fill passage is releasably, sealingly connected to the bottom side of the mold.

19. The method of claim 18 wherein the fill passage is removed from the bottom side after the mold is inverted.

20. The method of claim 15 wherein the molten metal is held in the inlet passages to at least delay molten metal run-out from the inlet passages and the mold cavity above the fill passage until the fill passage is drained and the mold is inverted.

21. A method for the countergravity casting of molten metal, comprising:

(a) relatively moving (1) a mold having an upstanding fill passage on a bottom side thereof for admitting molten metal to a mold cavity thereabove through a plurality of upstanding side-by-side, constricted inlet passages disposed in the mold between the fill passage and the mold cavity and (2) an underlying molten metal pool to immerse the fill passage in the underlying pool of molten metal, (b) applying a differential pressure between the mold and the pool while the fill passage is immersed in the pool to draw molten metal upwardly through the fill passage and the inlet passages to fill the mold cavity with the molten metal, (c) relatively moving the mold and the pool to remove the fill passage from the pool after the mold cavity is filled with molten metal while the entire metal in said mold cavity and inlet passages remains in the molten state, including (1) draining molten metal from the fill passage an (2) maintaining a differential pressure on the molten metal in the mold and establishing, for a given differential pressure, a molten metal surface tension holding action in the constricted inlet passages sufficient to delay molten metal run-out from the inlet passages and the mold cavity until the fill passage is drained of molten metal and the mold can be inverted, (d) inverting the mold after the fill passage is drained and before molten metal run-out from the inlet passages, and (e) solidifying the molten metal in the inlet passages and the mold cavity in the inverted mold.

22. A method for the countergravity casting of molten metal, comprising:

(a) relatively moving a mold having an upstanding fill passage on a bottom side thereof and an underlying molten metal pool to immerse the fill passage in the pool for supplying the molten metal to a mold cavity thereabove in the mold through upstanding constricted inlet passage means disposed in the mold between the fill passage and the mold cavity, (b) applying a differential pressure between the mold and the pool while the fill passage is immersed in the pool to draw molten metal upwardly through the fill passage, the inlet passage means and into the mold cavity to fill said mold cavity with said molten metal, (c) relatively moving the mold and the pool to remove the fill passage from the pool after the mold cavity is filled with said molten metal while the entire metal in said mold cavity and inlet passage means remains in the molten state, including (1) draining the molten metal from the fill passage and (2) maintaining a differential pressure on the molten metal in the mold for holding the molten metal in the constricted inlet passage means and the mold cavity thereabove until the fill passage is drained of molten metal, and (d) solidifying the molten metal in the constricted inlet passage means.

23. The method of claim 22 including releasing the differential pressure maintained on the molten metal by providing ambient pressure about the mold after the molten metal solidifies in the constricted inlet passage means such that the molten metal in the mold cavity solidifies under ambient pressure.

* * * * *